US007819506B2

(12) United States Patent
Graham et al.

(10) Patent No.: US 7,819,506 B2
(45) **Date of Patent: *Oct. 26, 2010**

(54) FLEXIBLE ENCAPSULANT MATERIALS FOR MICRO-FLUID EJECTION HEADS AND METHODS RELATING THERETO

(75) Inventors: David Christopher Graham, Lexington, KY (US); Eric Spencer Hall, Lexington, KY (US); Gary Anthony Holt, Jr., Lexington, KY (US); Richard Leo Hubert, II, Lexington, KY (US); Johnny Dale Massie, Lexington, KY (US); Sean Terrance Weaver, Union, KY (US); Jonathan Harold Laurer, Boone, NC (US); Rich Wells, Westerville, OH (US)

(73) Assignee: Lexmark International, Inc., Lexington, KY (US)

( * ) Notice: Subject to any disclaimer, the term of this patent is extended or adjusted under 35 U.S.C. 154(b) by 646 days.

This patent is subject to a terminal disclaimer.

(21) Appl. No.: 11/685,334

(22) Filed: Mar. 13, 2007

(65) Prior Publication Data

US 2007/0229575 A1 Oct. 4, 2007

Related U.S. Application Data

(60) Provisional application No. 60/743,920, filed on Mar. 29, 2006, provisional application No. 60/807,200, filed on Jul. 13, 2006.

(51) Int. Cl.
*B41J 2/05* (2006.01)

(52) U.S. Cl. ..... 347/64

(58) Field of Classification Search ..... 347/20, 347/63, 64

See application file for complete search history.

(56) References Cited

U.S. PATENT DOCUMENTS 5,561,176 A * 10/1996 Garafalo et al. ..... 523/213
6,255,738 B1 * 7/2001 Distefano et al. ..... 257/788

* cited by examiner

*Primary Examiner*—An H Do

(57) ABSTRACT

Thermally curable encapsulant compositions, micro-fluid ejection devices, and methods for protecting micro-fluid ejection heads. One such encapsulant composition may include one having from about 50.0 to about 95.0 percent by weight of at least one cross-linkable resin having a flexible backbone; from about 0.1 to about 20.0 percent by weight of at least one thermal curative agent; and from about 0.0 to about 50.0 percent by weight filler, and exhibits a relatively low shear modulus upon curing (e.g., less than about 10.0 MPa at 25° C.).

17 Claims, 8 Drawing Sheets

FLEXIBLE ENCAPSULANT MATERIALS FOR MICRO-FLUID EJECTION HEADS AND METHODS RELATING THERETO

RELATED APPLICATIONS

This application claims the benefit of provisional application Ser. No. 60/743,920, filed Mar. 29, 2006, and provisional application Ser. No. 60/807,200, filed Jul. 13, 2006.

TECHNICAL FIELD

The disclosure relates to encapsulant compositions, and in one particular embodiment, to flexible compounds that may be thermally cured for use as encapsulant materials in micro-fluid ejection devices.

BACKGROUND AND SUMMARY

Micro-fluid ejection heads are useful for ejecting a variety of fluids including inks, cooling fluids, pharmaceuticals, lubricants and the like. A widely used micro-fluid ejection head is an inkjet print head used in an ink printer. Ink jet printers continue to be improved as the technology for making their micro-fluid ejection heads continues to advance.

In the production of conventional thermal ink jet print cartridges for use in ink jet printers, one or more micro-fluid ejection heads are typically bonded to one or more chip pockets of an ejection device structure. A micro-fluid ejection head typically includes a fluid-receiving opening and fluid supply channels through which fluid travels to a plurality of bubble chambers. Each bubble chamber includes an actuator such as a resistor which, when addressed with an energy pulse, momentarily vaporizes the fluid and forms a bubble which expels a fluid droplet. The micro-fluid ejection head typically comprises an ejector chip and a nozzle plate having a plurality of discharge orifices formed therein.

A container, which may be internal with, detachable from or remotely connected to (such as by tubing) the ejection device structure, serves as a reservoir for the fluid and includes a fluid supply opening that communicates with a fluid-receiving opening of a micro-fluid ejection head for supplying ink to the bubble chambers in the micro-fluid ejection head.

During assembly of the micro-fluid ejection head to the ejection device structure, an adhesive is used to bond the ejection head to the ejection device structure. The adhesive "fixes" the micro-fluid ejection and to the ejection device structure such that its location relative to the ejection device structure is substantially immovable and does not shift during processing or use of the ejection head. The bonding and fixing step often referred to as a "die attached step." Further, the adhesive may provide additional functions such as serving as a fluid gasket against leakage of fluid and as corrosion protection for conductive tracing. The latter function for the adhesive is referred to as apart of the adhesive's encapsulating function, thereby further defining the adhesive as an "encapsulant" to protect electrical component connections, such as a flexible circuit (e.g., a TAB circuit) attached to the micro-fluid ejection head, from corrosion.

However, the micro-fluid ejection head and the ejection device structure typically have dissimilar coefficients of thermal expansion. For example, micro-fluid ejection heads may have silicon or ceramic substrates that are bonded to an ejection device structure that may be a polymeric material such as a modified phenylene oxide. Thus, the adhesive and encapsulant must accommodate both dissimilar expansions and contractions of the micro-fluid ejection head an the ejection device structure, and the resistant to attack by the ejected fluid.

Conventional adhesive and encapsulant materials tend to be non-flexible and brittle after curing due to high temperatures required for curing and relatively high shear modulus of the adhesive materials upon curing. Such properties may cause the adhesive or encapsulant materials to chip or crack. It may also cause the components (e.g., micro-fluid ejection head and/or ejection device structure) to bow, chip, crack, or otherwise separate from one another, or to be less resilient to external forces (e.g., chips may be more prone to crack when dropped). For example, during a conventional thermal curing process, the ejection device structure typically expands before a conventional die bond adhesive and encapsulant material are fully cured. The diebond material and encapsulant material thus move with the expanding device structure, wherein the diebond material and encapsulant material cure with the device structure in an expanded state. Upon cooling the device structure, the device structure contracts and, with a rigid cured diebond material or a rigid cured encapsulant material, high stress may be induced onto the ejection head structure to cause the aforementioned bowing, chipping, cracking, separating, etc.

Such adverse effects as bowing, chipping, cracking, separating, etc., may be even more pronounced as the substrates for the device structure are made thinner. Among other problems, such events may result in fluid leakage, corrosion of electrical component, and poor adhesion as well as malfunctioning of the micro-fluid ejection heads, such as misdirected nozzles. Moreover, attempts to make adhesive materials and encapsulant materials more flexible after curing often lead to materials that are less resistant to chemical degradation by the fluids being ejected.

Accordingly, a need exists for, amongst other things, a flexible encapsulant material that is curable at relatively low temperatures and that is suitable for use in assembling micro-fluid ejection head components, and particularly, for protecting electrical connections to a substrate for a micro-fluid ejection head.

With regard to the foregoing and other object and advantages, various embodiments of the disclosure provide a thermally curable encapsulant material for a micro-fluid ejection head and methods for making a micro-fluid ejection head having increased planarity. The encapsulant material may be provided by a composition including from about 50.0 to about 95.0 percent by weight of at least one cross-linkable epoxy resin having a flexible backbone, from about 0.1 to about 20.0 percent by weight of at least one thermal curative agent, and from about 0.0 to about 50.0 percent by weight filler. Upon curing the encapsulant material exhibits a relatively low shear modulus.

Additionally, embodiments provide a method for protecting a micro-fluid ejection head. The method includes applying a thermally curable encapsulant material adjacent to a fluid ejection surface of the ejection head. The encapsulant material contains from about 50.0 to about 95.0 percent by weight of at least one cross-linkable epoxy resin having a flexible backbone, from about 0.1 to about 20.0 percent by weight of at least one thermal curative agent, and from about 0.0 to about 50.0 percent by weight filler. The encapsulant material is cured and when cured exhibits a relatively low shear modulus.

Other exemplary embodiments of the disclosure may provide a micro-fluid ejection head having a thermally curable encapsulant disposed adjacent to a fluid ejection surface thereof, wherein the encapsulant has a shear modulus of less than about 10.0 MPa at 25° C.; and/or glass transition temperature of less than about 90° C.

Advantages of the exemplary embodiments may include, but are not limited to, a reduction in ejector chip substrate bow, an increase in ejector head durability, increased planarity of the ejector head, and the like. The planarity of an ejector head is defined as the slope of each fluid ejection nozzle. Other advantages may include the provision of adhesives and encapsulant materials having improved mechanical, adhesive, and corrosion resistance properties. Reduced stresses, which may reduce ejection head fragility, may be present in the ejector head substrates due to the presence of improved encapsulant material and/or die bond adhesives according to the disclosed embodiments.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

In general, the disclosure is directed to improved compositions, structures, and methods related to thermally curable encapsulant materials used to assemble component parts of micro-fluid ejection devices. More specifically, the improved encapsulant compositions discussed herein might be used to, for example, reduce residual stresses that may result from heat-treating micro-fluid ejection heads to harden and cure the encapsulant materials.

Figure 1:
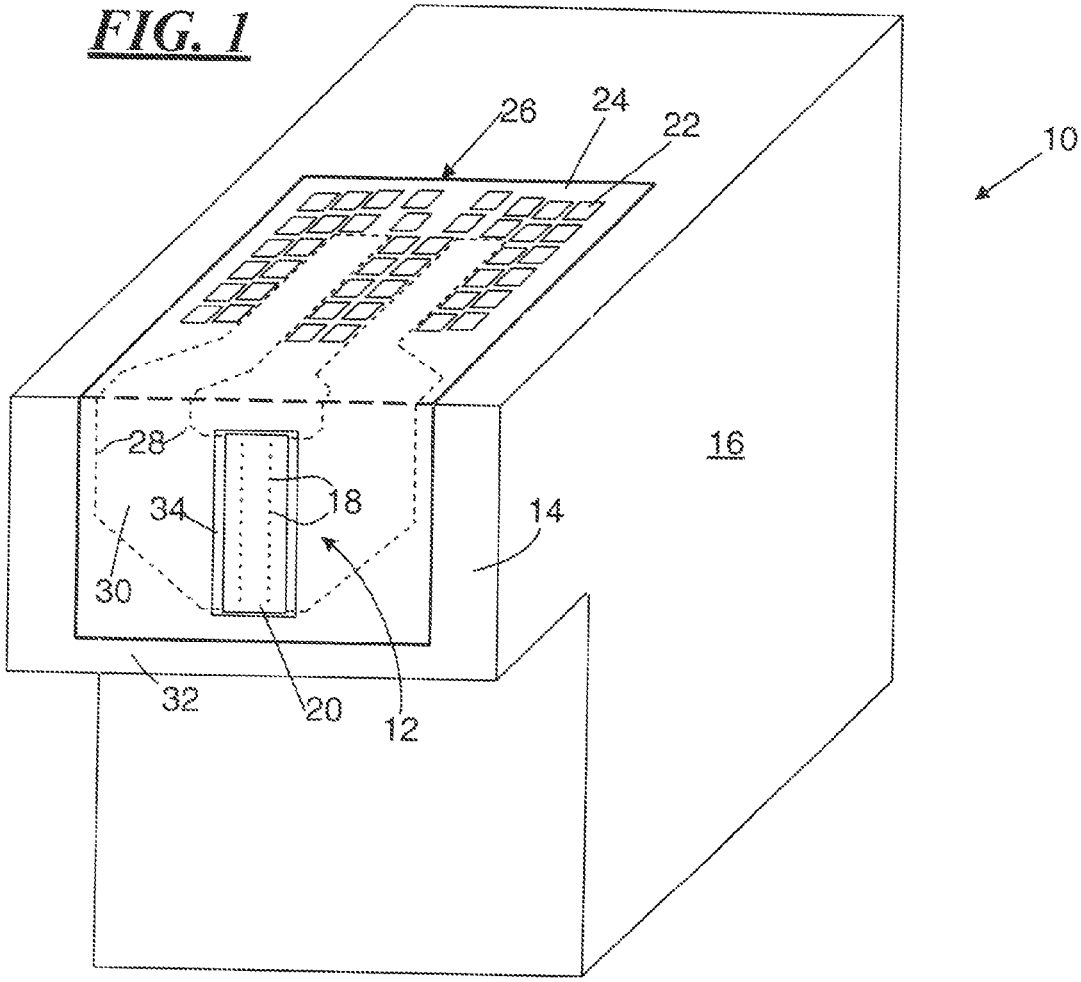
FIG. 1 is a perspective view of a micro-fluid ejection device according to an exemplary embodiment of the disclosure.

In order to more fully disclose various embodiments, attention is directed to the following description of a representative micro-fluid ejection device incorporating the improved thermally curable encapsulant material described herein. With reference to FIG. 1, there is shown, in perspective view, a micro-fluid ejection device 10 including one or more micro-fluid ejection heads 12 attached to a head portion 14 of the device 10. A fluid reservoir 16 containing one or more fluids is fixedly (or removably) attached to the head portion 14 for feeding fluid to the one or more micro-fluid ejection heads 12 for ejection of fluid toward a media or receiving surface from nozzles 18 on a nozzle plate 20. Although FIG. 1 illustrates the fluid reservoir being directly attached to a head portion 14, other embodiments might attach a fluid reservoir indirectly to a head portion, such as by tubing, for example. Each reservoir 16 may contain a single fluid, such as a black, cyan, magenta, or yellow ink or may contain multiple fluids. In the illustration shown in FIG. 1, the device 10 has a single micro-fluid ejection head 12 for ejecting a single fluid. However, the device 10 may contain two or more ejection heads for ejecting two or more fluids, or a single ejection head 12 may eject multiple fluids, or other variations on the same.

Figure 2:
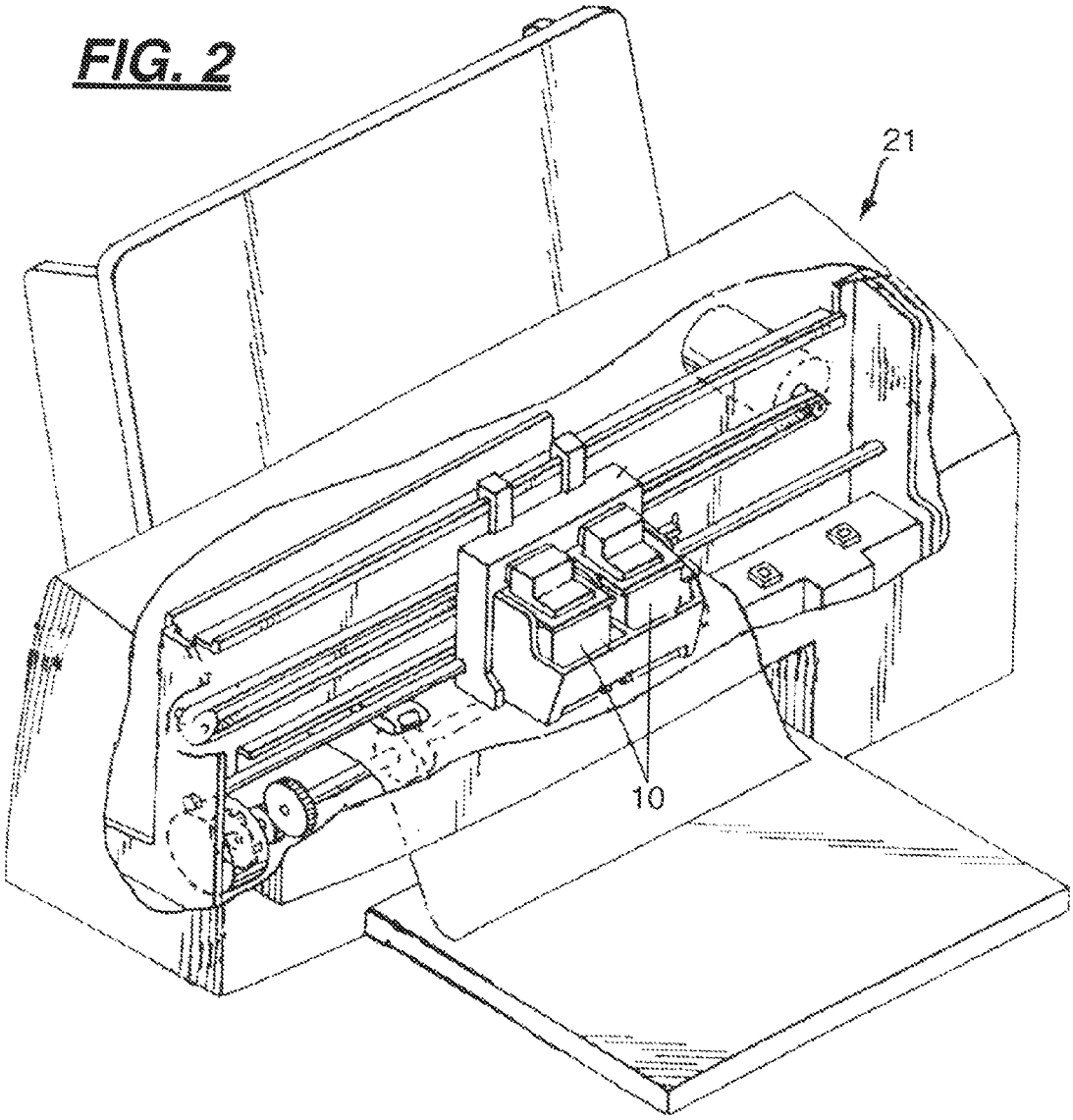
FIG. 2 is a perspective view, not to scale, of an ink jet printer capable of controlling a micro-fluid ejection device according to the disclosure.

In order to control the ejection of fluid from the nozzles 18, each of the micro-fluid ejection heads 12 is usually electrically connected to a controller in an ejection control device, such as, for example, a printer 21 (FIG. 2), to which the device 10 is attached. In the illustrated embodiment, connections between the controller and the device 10 are provided by contact pads 22 which are disposed on a first portion 24 of a flexible circuit 26. An exemplary flexible circuit 26 is formed from a resilient polymeric film, such as a polyimide film, which has conductive traces 28 thereon for conducting electrical signals from a source to the ejection head 12 connected to the traces 28 of the flexible circuit 26.

A second portion 30 of the flexible circuit 26 is typically disposed on an operative side 32 of the head portion 14. The reverse side of the flexible circuit 26 typically contains the traces 28 which provide electrical continuity between the contact pads 22 and the micro-fluid ejection heads 12 for controlling the ejection of fluid from the micro-fluid ejection heads 12. TAB bond or wire bond connections, for example, are made between the traces 28 and each individual micro-fluid ejection head 12 as described in more detail below.

Figure 3:
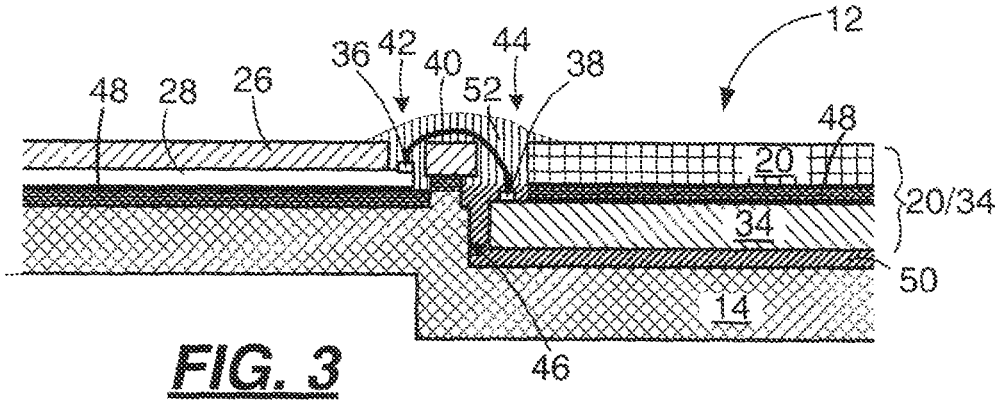
FIG. 3 is a cross-sectional view, not to scale, of a portion of a micro-fluid ejection device according to an embodiment of the disclosure.

Exemplary connections between a flexible circuit and a micro-fluid ejection head are shown in detail by reference to FIG. 3. As described above, flexible circuits 26 contain traces 28 which are electrically connected to a substrate 34. The substrate 34 may be part of an ejector chip having resistors and/or other actuators, such as piezoelectric devices or MEMs devices for inducing ejection of fluid through nozzles 18 of a nozzle plate 20 toward a media or receiving surface. Connection pads 36 on the flexible circuits 26 are operatively connected to bond pads 38 on the substrate 34, such as by TAB bonding techniques or by use of wires 40 using a wire bonding procedure through windows 42 and/or 44 in the circuit 26 and/or nozzle plate 20.

As shown in FIG. 3, the substrate 34 is attached to the head portion 14, such as in a chip pocket 46. Prior to attaching the substrate 34 to the head portion 14, a nozzle plate 20 may be adhesively attached to the ejector chip using adhesive 48 (in another embodiment, a nozzle plate may be attached to the ejector chip by forming the nozzle plate on the substrate using photoimageable techniques). The assembly provided by the nozzle plate 20 attached to the substrate 34 is referred to herein as the nozzle plate/substrate assembly 20/34 (FIG. 3). In some embodiments, the assembly 20/34 encompasses the micro-fluid ejection head itself.

The adhesive 48 may be a heat curable adhesive such a B-stageable thermal cure resin, including, but not limited to phenolic resins, resorcinol resins, epoxy resins, ethylene-urea resins, furane resins, polyurethane resins and silicone resins. The adhesive 48 may be cured before attaching the substrate 34 to the head portion 14 and, in an exemplary embodiment, the adhesive 48 has a thickness ranging from about 1 to about 25 microns.

After bonding the nozzle plate 20 and substrate 34 together, the nozzle plate/substrate assembly 20/34 may be attached to the head portion 14 in chip pocket 46 using a conventional die bond adhesive 50. In other embodiments of the disclosure, the die bond adhesive 50 used to connect the nozzle plate/substrate assembly 20/34 to the head portion 14 includes a flexible adhesive having a relatively low shear modulus.

For the purposes of this disclosure, "shear modulus" involves the relation of stress to strain according to Hooke's Law as shown in Equation (1) as follows:

$$\text{stress}=\mu(\text{strain}) \quad (1)$$

In Equation (1), "μ" represents a quantity often referred to as rigidity. When the relationship illustrated by Equation (1) is applied to a force "F" across a given area "A," Equation (1) may be more specifically represented by Equation (2) as follows:

$$F/A=\mu(\Delta L/L) \quad (2)$$

In Equation (2) above, the variable "L" represents original length of an object before said object was acted upon by force F. "ΔL" represents the change in length occurring after force "F" has acted upon the object. Therefore, the rigidity ("μ") of the object is a proportionality constant relating the pressure applied to an object with the ratio between the object change in length with the objects original length.

When Equation (2) and a given rigidity value "μ" are used to determine elastic properties of an object, Equation (3), shown below, is used to derive a shear modulus value from the rigidity "μ" value determined in Equation (2). Equation (3) is shown below as follows:

$$\mu=E/2(L+\nu) \quad (3)$$

In Equation (3) above, shear modulus is the proportional relationship between rigidity "μ" and the right hand side of the equation, including the Poisson ratio "ν" and Young's modulus "E."

Applying Hooke's Law and elasticity theory to physical properties of micro-fluid ejection heads, reliable data may be established to correlate the elastic properties of adhesives and encapsulants with the effect of said adhesives on one or more surfaces of a micro-fluid ejection head. Shear modulus values are dependent on temperature, therefore, a given shear modulus value for a given adhesive or encapsulant will be given in pressure units at a specific temperature. Various embodiments of the disclosure include compositions with shear modulus values of less than 10 MPa at 25° C. as determined by a rheometer from TA Instruments of New Castle, Del. under the trade name ARES in a dynamic parallel plate configuration with a frequency of 1.0 rad/sec and a strain of 0.3% after the material is cured.

In a prior art ejection head, a relatively rigid, or non-flexible encapsulant material is used to encapsulate and protect the wires 40, connection pads 36, and bond pads 38. Exploded views of micro-fluid ejection device, components of the micro-fluid ejection device, and encapsulant material placement are illustrated in FIGS. 4-7.

Figure 4:
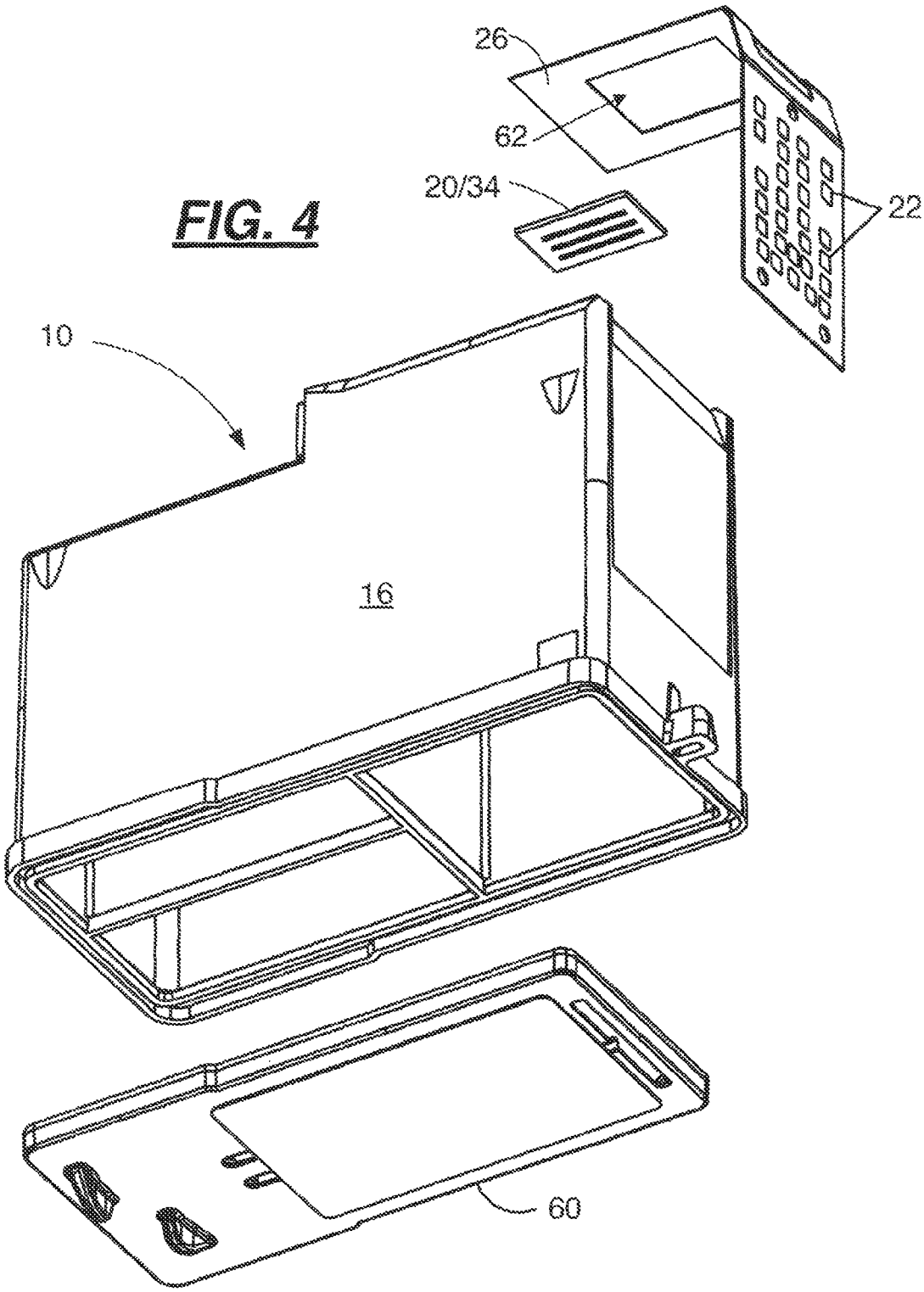
FIGS. 4-5 are exploded perspective views, not to scale, of a micro-fluid ejection device according to an exemplary embodiment of the disclosure.
Figure 5:
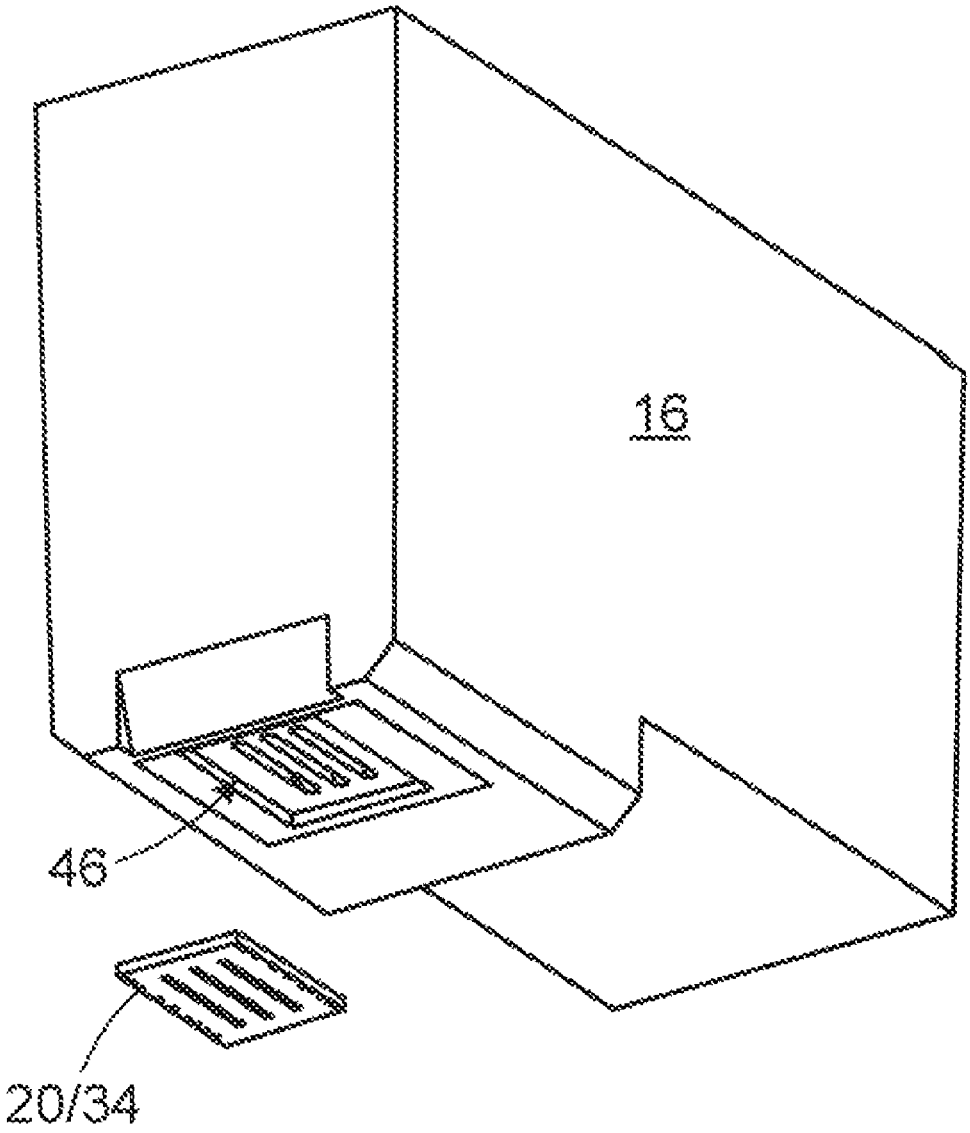

FIGS. 4-5 are exploded, perspective view of a micro-fluid ejection device 190 illustrating a multi-cavity fluid reservoir 16 and cover 60 thereof. A nozzle plate/substrate assembly 20/34 is attached in the chip pocket 46 of the reservoir 16 (FIG. 5), and the flexible circuit 26 is attached to the substrate 34 as described above.

Figure 6:
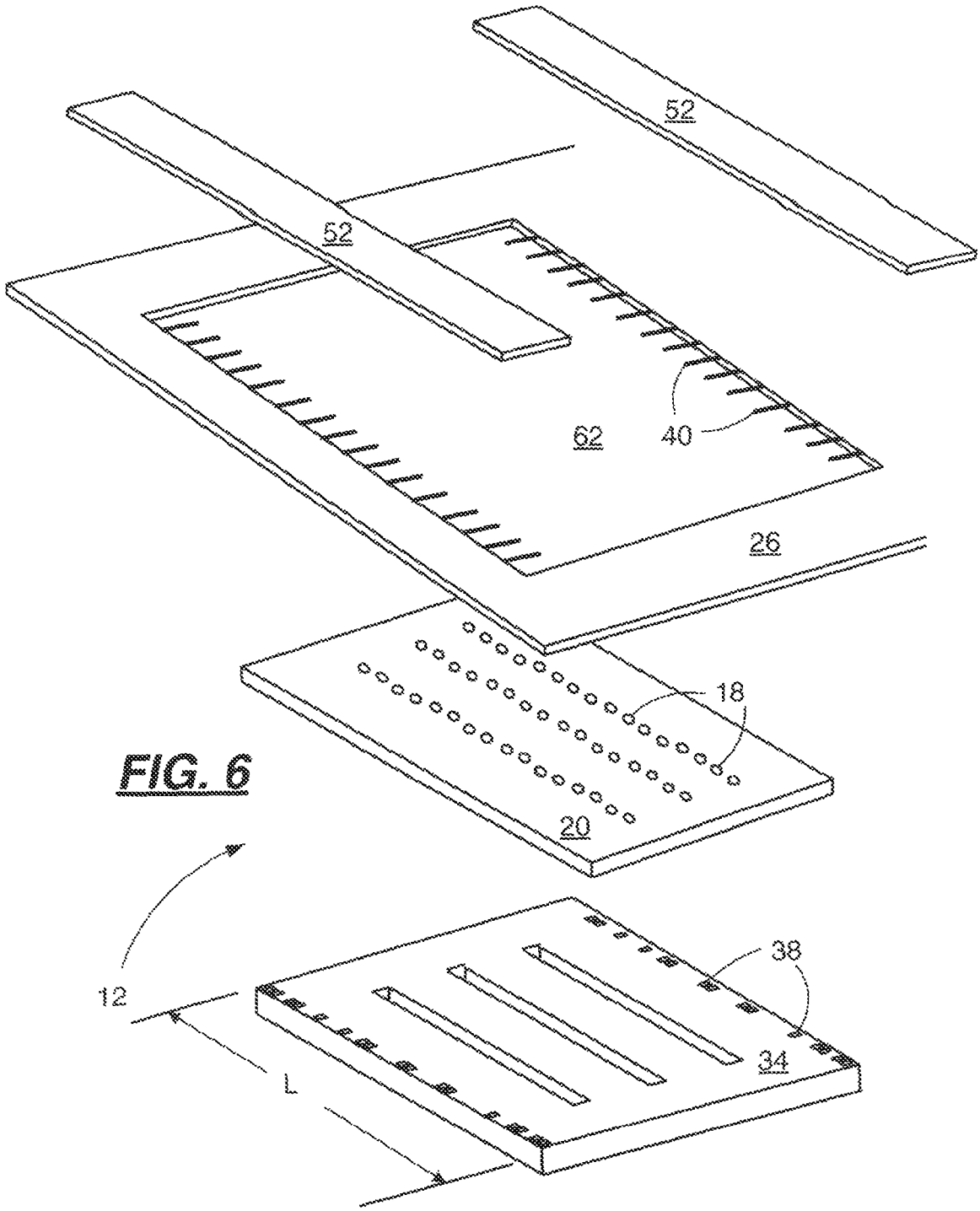
FIG. 6 is an exploded perspective view of a micro-fluid ejection head assembly and encapsulant material according to an embodiment of the disclosure.
Figure 7:
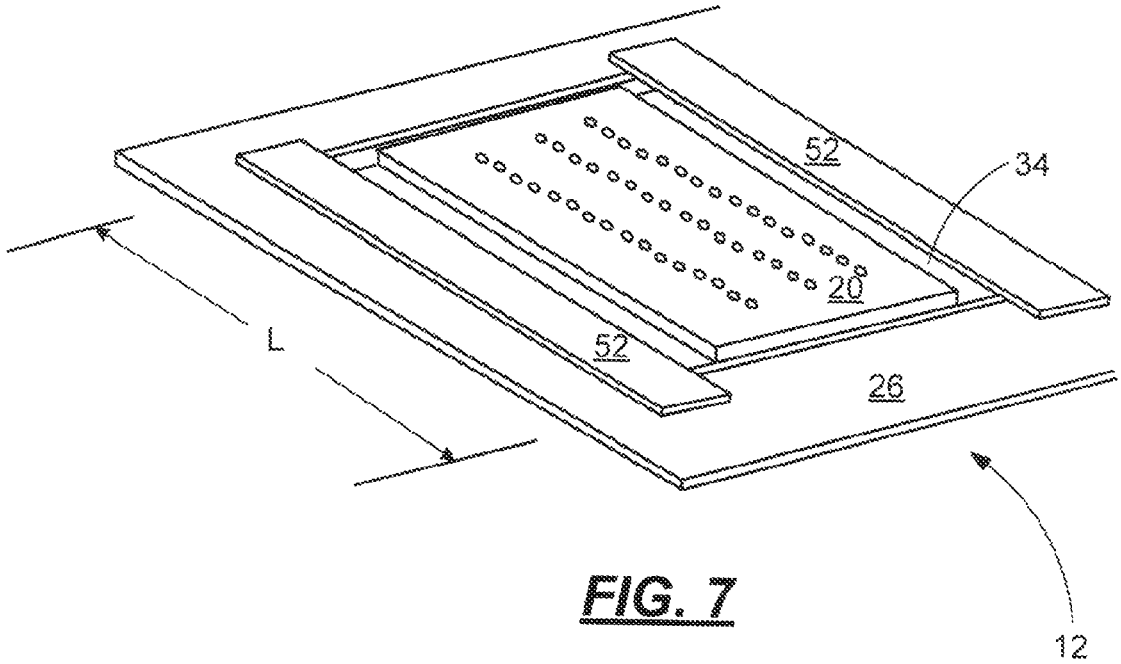
FIG. 7 is a perspective view of the micro-fluid ejection head assembly of FIG. 6.

As shown in more detail in FIG. 6, the flexible circuit 26 includes a window 62 containing wires 40 for connection to the bond pads 38 on the substrate 20. After connecting the wires 40 to the bond pads 38, encapsulant material 52 is deposited adjacent to the wire 40 and bond pad 38 connections to protect the connections from corrosion. In the embodiment illustrated in FIG. 6, bond pads 38 are along a length L of the substrate 20. Accordingly, longitudinal strips of encapsulant material 52 are provided along the length L of the substrate as shown in FIG. 7.

Figure 8:
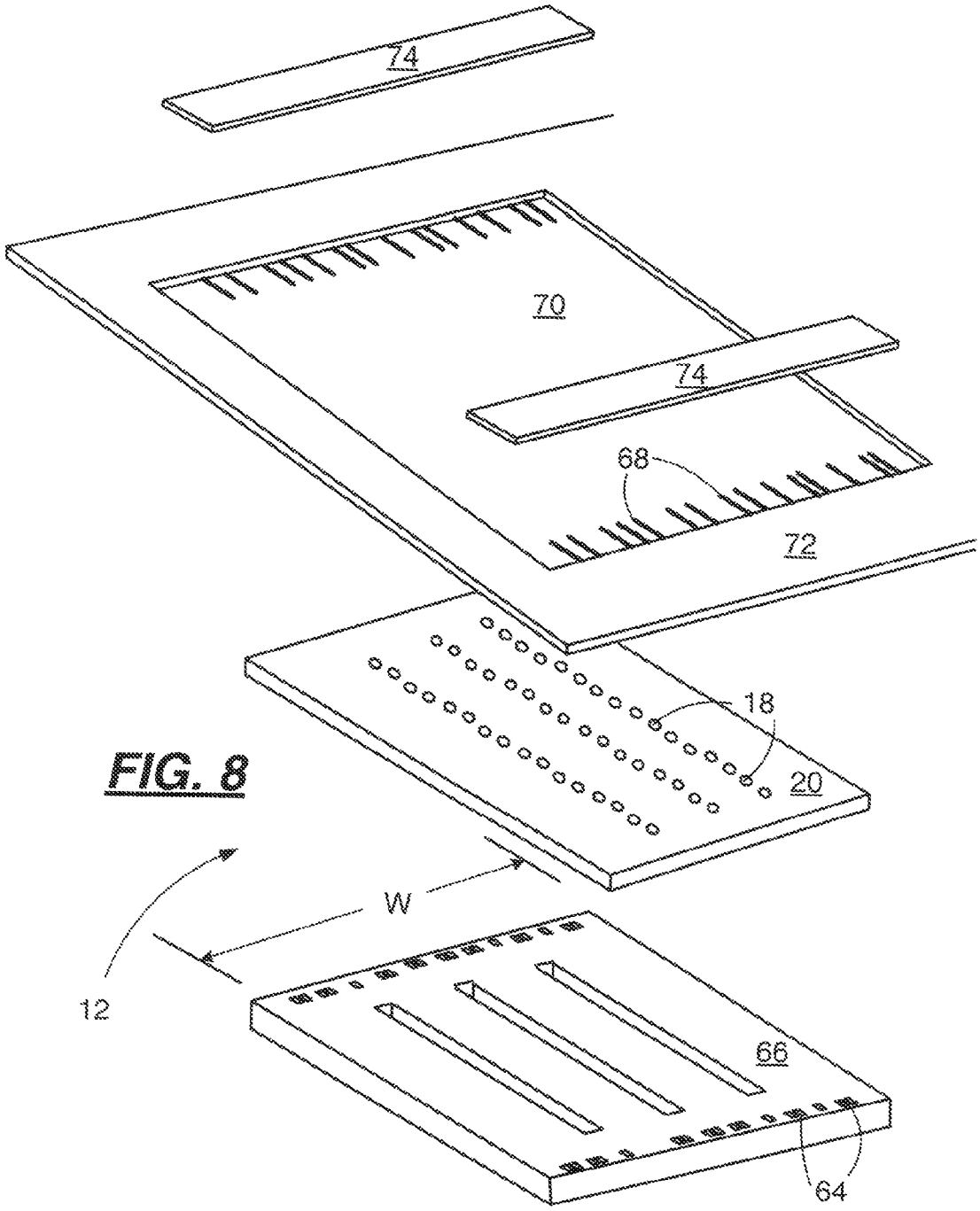
FIG. 8 an exploded perspective view of a micro-fluid ejection head assembly and encapsulant material according to another embodiment of the disclosure.

In an alternative embodiment, illustrated in FIG. 8, bond pads 64 are along a width W of a substrate 66. Likewise, wires 68 in a window 70 of a flexible circuit 72 are arranged to correspond to the bond pads 64 on the substrate 66. In this embodiment, encapsulant material 74 is disposed adjacent to the bond pad 64 and wire 68 connections along the width W of the substrate 66. In other embodiments, bond pads may be along both the width W and length L of the substrate 20 and 66 with corresponding encapsulant material disposed along the width W or length L thereof. It will be appreciated that the die bond adhesive 50 (FIG. 3) may be sufficient to encapsulate at least a portion of the wires 40 or 68 and bond pads 38 or 64 from the chip pocket 46 side of the head portion 14.

Figure 9:
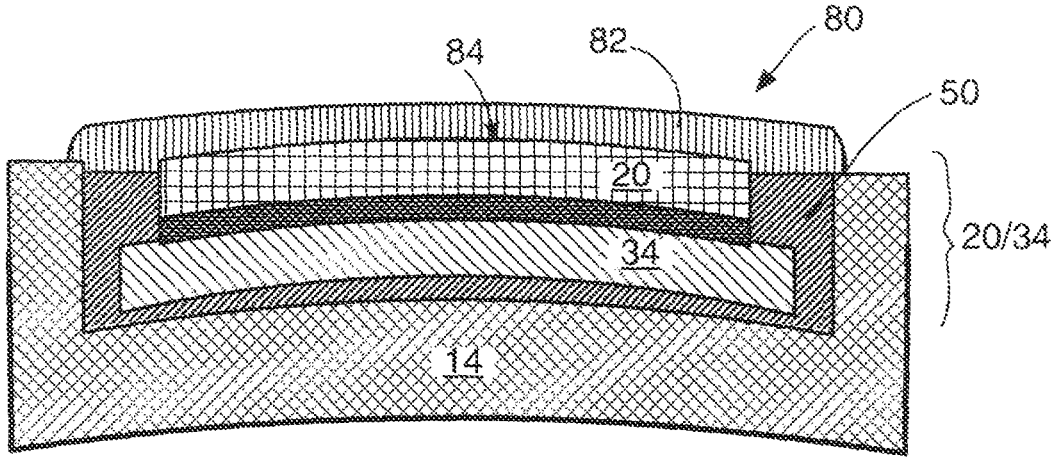
FIG. 9 PRIOR ART
FIG. 9 is a cross-sectional view, not to scale, of a micro-fluid ejection device incorporating a prior art encapsulant material.

Regardless of whether the encapsulant material is placed along the length L or the width W or both, curing of the encapsulant material and adhesives may result in bowing of the ejection head structure if a substantially non-flexible encapsulant material is used. With reference to FIG. 9, a cross-sectional view of a non-planar micro-fluid ejection head 80 (e.g., nozzle plate/substrateassembly 20/34) containing a prior art encapsulant material 82 illustrated. (For purposes of clarity only, details of the connections are not illustrated).

In the prior art ejection head 80, the encapsulant material 82 is relatively rigid and has a relatively high shear modulus and a relatively high glass transition temperature. For example, the prior art encapsulant material 82 has a shear modulus of about 15 MPa at 25° C. and a glass transition temperature of about 92° C.

The glass transition temperature of a material with elastic properties is the temperature at which the material transitions to more brittle physical properties or more elastic physical properties, depending on whether the temperature is decreasing or increasing, respectively. Upon curing, as the encapsulant material 82 is cooled below its glass transition temperature, the encapsulant material 82 becomes significantly more brittle than before reaching its glass transition temperature. If the encapsulant material 82 is stretched or compressed at a temperature below its glass transition temperature, the encapsulant material 82 may crack or buckle. Therefore, using encapsulant materials with lower glass transition temperatures will decrease the chances of the encapsulant material cracking or buckling.

Similarly, considering that shear modulus values directly relate to how brittle an encapsulant material will be at a given temperature, encapsulant materials having lower shear modulus values are more flexible at lower temperatures, thereby decreasing the likelihood of the encapsulant material cracking or buckling. Encapsulant material cracking may result in a compromised fluid seal, whereby micro-fluid ejection fluid leaks from the nozzle plate/substrateassembly 20/34 might cause undesirable deposits of fluid, and/or corrosion of electrical components.

High curing temperatures may also cause increased micro-fluid ejection head fragility. Increased fragility of micro-fluid ejection heads increases the chances for micro-fluid ejection products becoming unfit for use due to shattering of micro-fluid ejections heads and other parts of the micro-fluid ejection device. Chip fragility is believed to increase in severity because the encapsulant material 82 reaches its glass transition temperature ($T_g$) before the nozzle plate/substrateassembly 20/34 and head portion 14 have finished cooling and contracting relative to one another after the curing of the encapsulant material 82, imparting stress onto the nozzle plate/substrate assembly 20/34. Encapsulant materials having lower shear modulus values and lower glass transition temperatures may be cured with lower temperatures thereby, decreasing the chances for increased micro-fluid ejection head fragility.

Upon curing, stresses in the ejection head 80 are caused by the encapsulant material 82 that expands during a curing process at a different rate than the other components of the ejection head 80. Other components of the ejection head 12 contract while the cured encapsulant material 82 remains in an expanded state during cooling. The resulting stresses cause deformation within the substrate 20 and/or nozzle plate 34 leading to a non-planar surface 84, as shown in FIG. 9, that may cause misdirection of fluid ejected from the nozzles 18.

Chip bowing typically results from the nozzle plate/substrate assembly 20/34 and the head portion 14 having dissimilar coefficients of thermal expansion, since the substrate 20 bonded to the head portion 14 most commonly is silicon or ceramic and the portion 14 is, for example, typically a polymeric material such as a modified phenylene oxide. Thus, the encapsulant material should be flexible enough to accommodate both the dissimilar expansions and contractions of the nozzle plate/substrate assembly 20/34 and the head portion 14. Chip bowing may result in nozzles being misaligned or aligned at an undesirable angle (often called "planarity" of nozzles), which may also diminish the quality of fluid ejected from the nozzles.

Figure 10:
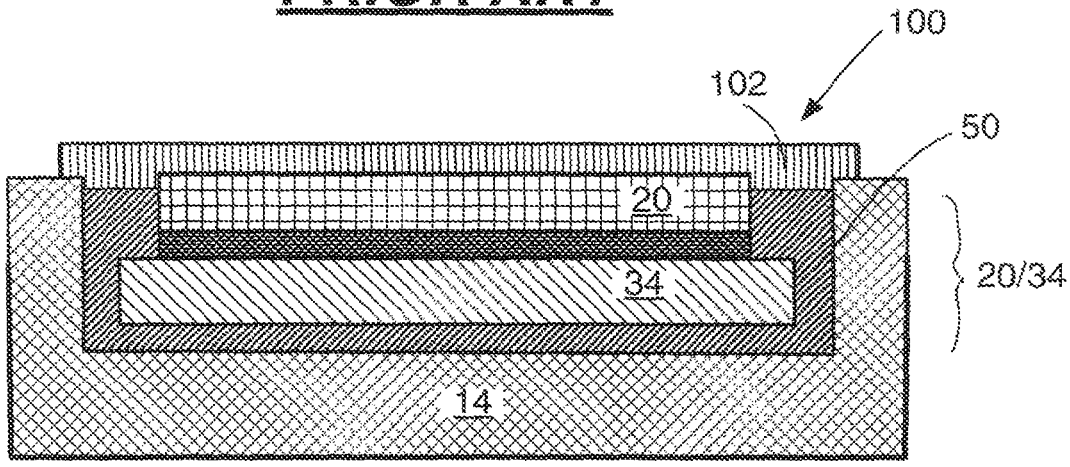
FIG. 10 is a cross-sectional cutaway side view, not to scale, of a portion of a micro-fluid ejection device according to an embodiment of the disclosure.

In an exemplary embodiment of disclosure, an encapsulant material is used that has glass transition temperature below the temperature to which the head portion 14 is cooled and a relatively low shear modulus. For example, an encapsulant material with a glass transition temperature of less than about 80° C., such as one having a glass transition temperature of less than about 65° C. and a shear modulus of less than about 15 MPa at 25° C., for example less than 10 MPa at 25° C. may be used in an exemplary embodiment. FIG. 10 illustrates an ejection head 100 having improved planarity as a result of using an excapsulant material 102 according to the disclosure.

For the purposes of certain embodiments in this disclosure, "relatively low shear modulus" is defined as shear modulus at least lower than about 10 MPa at 25° C. "Relatively low shear modulus" may, however, be defined as a shear modulus lower than about 5.0 MPa at 25° C. for certain exemplary embodiments disclosed here.

In an exemplary embodiment, the encapsulant material may be composition including (1) from about 50.0 to about 95.0 percent by weight of at least one cross-linkable epoxy resin having a flexible backbone; (2) from about 0.1 to about 20.0 percent by weight of at least one thermal curative agent selected from the group of imidazoles, amines, peroxides, organic accelerators, sulfur, and mixed onium salts such as arsonium antimonium and bimuthonium salts; and (3) from about 0.0 to about 50.0 percent by weight filler, wherein the composition exhibits a relatively low shear modulus upon curing. In some variations of these exemplary embodiments, the encapsulant material may include from about 0.0 to about 10.0 percent by weight silane coupling agent. In the embodiments described above, the filler may include from about 0.0 to about 20.0 percent by weight fumed silica or another filler component such as clay or functionalized clay, silica, talc, carbon black, carbon fibers.

More specific exemplary embodiments of the composition of the encapsulant material according to the disclosure are listed in Tables 1 through Table 3 below.

TABLE 1

(Composition 1)

| Material | Concentration (percent by weight) | Trade name | Supplier |
|---|---|---|---|
| Flexible epoxy resin | 70.0-85.0 | EXA-4850 | Dainippon Ink |
| Bisphenol M | 8.0-10.0 | Bisphenol M | Aldrich |
| Imidazole catalyst | 9.0-11.0 | CUREZOL-17-Z | Air Products |
| Epoxy Silane | 0.5-1.5 | A-187 | GE Silicones |
| Amine adduct | 0-5.0 | ANCAMINE 2337 | Air Products |
| Fumed Silica | 0-5.0 | TS-720 | Cabot |

As shown above, composition 1 includes from about 70.0 to about 85.0 percent by weight multi-functional epoxy resin and from about 8.0 to about 10.0 percent by weight phenolic cross-linking agent. The composition also includes from about 9.0 to about 11.0 percent by weight of an imidazole catalyst and from about 0.0 to about 5.0 weight percent filler. Optional components include from about 0.5 to about 1.5 wt. % silane coupling agent and from about 0 to about 5.0 wt. % amine adduct. As shown in Table 4, Composition 1 has a relatively low shear modulus value of about 4.4 MPa at 25° C. a and a low glass transition temperature of about 30.8° C. There are a number of epoxy resins, curing agents, and fillers available for application with various embodiments of the invention. In the first composition illustrated in Table 1, an exemplary multi-functional epoxy resin is available from Dainippon Ink and Chemicals, Inc. of Tokyo, Japan under the trade name EPICLON EXA-4850.

A suitable phenolic cross-linking agent is available from Sigma Aldrich Company under the trade designation Bisphenol M. A useful curing agent is available from Air Products and Chemicals, Inc. under the trade name CUREZOL C17Z. A suitable epoxy silane coupling agent is available from GE Advanced Materials, Silicones of Wilton, Conn. under the trade name SILQUEST A-187 SILANE. A suitable filler, such as fumed silica, is available from a number of different suppliers. For example, fumed silica is available from Cabot Corporation of Boston, Mass. under the trade name CAB-O-SIL TS-720. A suitable amine adduct is available from Air Products and Chemical, Inc. under the trade name ANCAMINE 2337.

TABLE 2

(Composition 2)

| Material | Concentration (percent by weight) | Trade name | Supplier |
|---|---|---|---|
| Flexible epoxy resin | 75.0-90.0 | EXA-4850 | Dainippon Ink |
| Imidazole catalyst | 10.0-11.0 | CUREZOL-17-Z | Air Products |
| Epoxy Silane | 0.5-1.0 | A-187 | GE Silicones |
| Amine adduct | 0-5.0 | ANCAMINE 2337 | Air Products |
| Fumed Silica | 0-5.0 | TS-720 | Cabot |

As provided in Table 2, Composition 2 includes from about 72.0 to about 90.0 percent be weight flexible epoxy resin, from about 10.0 to about 11.0 percent by weight of imidazole catalyst thermal curative agent, from about 0.5 to about 1.0 percent by weight epoxy silane coupling agent, from about 0 to about 5.0 percent by weight of amine adduct, and from about 0 about 5.0 percent by weight fumed silica. As shown in Table 4, Composition 2 has a low shear modulus value of about 1.75 MPa at 25° C. and a glass transition temperature ranging of about 20° C.

TABLE 3

(Composition 3)

| Material | Concentration (percent by weight) | Trade name | Supplier |
|---|---|---|---|
| Flexible epoxy resin | 55.0-90.0 | EXA-4850 | Dainippon Ink |
| Bisphenol-F | 0-30.0 | 830-LVP | Dainippon Ink |
| Imidazole catalyst | 7.0-8.5 | CUREZOL-17-Z | Air Products |
| Epoxy Silane | 0.5-1.0 | A-187 | GE Silicones |
| Amine adduct | 0-3.5 | ANCAMINE 2337 | Air Products |
| Fumed Silica | 0-3.5 | TS-720 | Cabot |

Table 3 illustrates yet another exemplary adhesive composition. As provided in Table 3, Composition 3 includes from about 55.0 to about 90.0 percent by weight flexible epoxy resin, from about 0.0 to about 30 percent by weight bisphenol-F, from about 7.0 to about 8.5 percent by weight of imidazole catalyst thermal curative agent, and from about 0.5 to about 1.0 silane coupling agent. As with the other compositions, Composition 3 may also include from about 0 to about 3.5 wt. % filler and from about 0 to about 3.5 wt. % amine adduct. As shown in Table 4, Composition 3 has a low shear modulus value ranging from about 3.9 to about 8.7 MPa at 25° C. and a glass transition temperature ranging from about 27.7 to about 60° C.

A comparison of the shear modulus and glass transition temperature properties of the Compositions 1-3 compared to a conventional encapsulant material available from Engineered Materials Systems, Inc. of Delaware, Ohio under the trade name EMS 502-39-1 are provided in Table 4.

TABLE 4

| Sample | Shear Modulus (MPa) (25° C.) | Tg (° C.) |
|---|---|---|
| EMS 502-39-1 | 15.0 | 92.0 |
| Composition 1 | 4.4 | 30.8 |
| Composition 2 | 1.75 | 20.0 |
| Composition 3 | 3.9-8.72 | 27.7-60 |

As illustrated in Table 4, the EMS encapsulant has a relatively high shear modulus value of 15 MPa at 25° C. as compared to the shear modulus values of the Composition 1-3 which are all less than 10 MPa at 25° C. Similarly, the EMS encapsulant has a relatively high glass transition temperature of 92° C. compared to the much lower values of the compositions 1-3 which are all less than 65° C. In other words, EMS encapsulant becomes significantly more rigid when it cools to about 92° C., whereas Compositions 1-3 do not become significantly more rigid until cooling to at least about 60° C.

A comparison of ejection head planarity in terms of ejection head bow was made with the compositions of Tables 1-3 and the conventional encapsulant material. In this example, the substrate 20 has a thickness of 450 microns. The results are given in the following table.

TABLE 5

| Sample | Average Chip Bow (microns) | Chip Bow Range (microns) |
|---|---|---|
| EMS 502-39-1 | −3.2 | −15 to 6 |
| Composition 1 | −2.3 | −1.70 to −2.70 |
| Composition 2 | +3.86 | 3.74 to 3.98 |
| Composition 3 | +2.90 | 2.20 to 3.50 |

As illustrated in Table 5, encapsulant materials according to the disclosure have significantly less chip bow ranges compared to the conventional encapsulant material, and result in less chip bow than the prior art encapsulant materials. The results may be even more pronounced with thinner substrates 20.

It is contemplated, and will be apparent to those skilled in the art from the preceding description and the accompanying drawings that modifications and/or changes may be made to the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A thermally curable encapsulant composition for a micro-fluid ejection head, the encapsulant composition comprising:

from about 50.0 to about 95.0 percent by weight of at least one cross-linkable epoxy resin having a flexible backbone;

from about 0.1 to about 20.0 percent by weight of at least one thermal curative agent selected from the group consisting of imidazoles and amines; and from about 0.0 to about 50.0 percent by weight filler, wherein the composition: exhibits a relatively low shear modulus upon curing.

2. The encapsulant composition of claim 1, further comprising from about 0.0 to about 10.0 percent by weight silane coupling agent.

3. The encapsulant composition of claim 1, wherein the filler comprises from about 0.0 to about 50.0 percent by weight fumed silica.

4. The encapsulant composition of claim 1, further comprising from about 0.0 to about 50.0 percent by weight phenolic cross-linking agent.

5. The encapsulant composition of claim 4, wherein the phenolic cross-linking agent is selected from the group consisting of bisphenol-F and bisphenol-M.

6. The encapsulant composition of claim 1, wherein the at least one thermal curative agent comprises an imidazole catalyst.

7. The encapsulant composition of claim 1, wherein the at least one thermal curative agent comprises an epoxy adduct of an aliphatic polyamine containing a primary amino group.

8. The encapsulant composition of claim 1, wherein the flexible backbone of the epoxy resin is selected from the group consisting of polyglycol, polybutadiene, and polysiloxane structures.

9. A micro-fluid ejection head comprising a thermally curable encapsulant disposed adjacent to a fluid ejection surface thereof, the encapsulant having a shear modulus of less than about 10.0 MPa at 25° C.

10. The micro-fluid ejection head of claim 9, wherein the encapsulant comprises an encapsulant material having a shear modulus of less than about 5.0 MPa at 25° C.

11. A micro-fluid ejection head comprising a thermally curable encapsulant disposed adjacent to a fluid ejection surface thereof, the encapsulant having a glass transition temperature of less than about 90° C.

12. The micro-fluid ejection head of claim 11, wherein the encapsulant comprises an encapsulant material having a glass transition temperature of less than about 60° C.

13. A method for protecting a micro-fluid ejection head comprising applying a thermally curable encapsulant material adjacent to a fluid ejection surface of the ejection head, the encapsulant material comprising:

from about 50.0 to about 95.0 percent by weight of at least one cross-linkable epoxy resin having a flexible backbone;

from about 0.1 to about 20.0 percent by weight of at least one thermal curative agent; and from about 0.0 to about 50.0 percent by weight filler, wherein the composition has a shear modulus of less than 10.0 MPa at 25° C., curing the adhesive composition to provide a micro-fluid ejection device.

14. The method of claim 13 wherein applying an encapsulant material comprises applying an encapsulant material comprising a mixture having a shear modulus of less than 3.0 MPa at 25° C.

15. The method of claim 13 wherein applying an encapsulant material comprises applying an encapsulant material comprising a mixture having a shear modulus of less than 1.0 MPa at 25° C.

16. The method of claim 13 wherein applying an encapsulant material comprises applying an encapsulant material comprising a mixture having a glass transition temperature of less than 65° C.

17. The method of claim 13 wherein applying an encapsulant material comprises applying an encapsulant material comprising a mixture having a glass transition temperature of less than 25° C.

* * * * *